United States Patent [19]

Jungkind

[11] Patent Number: 4,610,459

[45] Date of Patent: Sep. 9, 1986

[54] SKI BINDING

[75] Inventor: Roland Jungkind, Garmisch-Partenkirchen, Fed. Rep. of Germany

[73] Assignee: Metallwerk K. Pittl Ges.mbH & Co. KG, Fulpmes, Austria

[21] Appl. No.: 748,849

[22] Filed: Jun. 26, 1985

[30] Foreign Application Priority Data

Oct. 23, 1984 [DE] Fed. Rep. of Germany ..... 3438795

[51] Int. Cl.[4] ..... A63C 9/18

[52] U.S. Cl. ..... 280/615; 280/632; 280/635

[58] Field of Search ..... 280/615, 614, 631, 632, 280/635

[56] References Cited

U.S. PATENT DOCUMENTS 4,365,821 12/1982 Kreyenbuhl ..... 280/615

FOREIGN PATENT DOCUMENTS 2721976 1/1978 Fed. Rep. of Germany ..... 280/615

2526322 11/1983 France ..... 280/615

*Primary Examiner*—John J. Love

*Assistant Examiner*—Eric D. Culbreth

[57] ABSTRACT

A cross-country ski binding for use with a ski boot having a front extension portion on its sole, with the front end portion providing a hooking area on its top surface, has a double-armed retaining lever whose arm which faces towards the rear of the binding forms a hook for engaging behind the hooking area on the extension portion of the boot. The second arm of the retaining lever can be secured in the closed position of the binding by a locking lever pivotally mounted at the front end of the binding. The locking lever is spring-loaded towards the position of locking the retaining lever in the closed condition of the binding. The binding also has a release button which is disposed pivotally coaxially with respect to the retaining lever and which is limitedly pivotable relative to the retaining lever, against the force of a retaining spring, thereby to displace the locking lever into a position for releasing the retaining lever. The retaining lever also has an abutment which is engaged by the first extension portion of the boot upon insertion thereof into the binding to pivot the retaining lever into the binding-closing position.

10 Claims, 3 Drawing Figures

SKI BINDING

BACKGROUND OF THE INVENTION

The present invention relates generally to a ski binding and more particularly to a ski binding intended for use in cross-country skiing, which may be variously referred to as long-distance skiing, langlauf skiing or Nordic skiing. For the sake of simplicity herein, the term cross-country skiing will generally be used.

A cross-country ski binding is disclosed for example in German laid-open application (DE OS) No. 27 21 976, for a cross-country ski boot having a forwardly extended portion on the front end of the sole of the boot, the extended portion being of a stepped configuration to form a retaining hook means on its top. For that ski binding, a base plate which is to be fixed with respect to the ski has two side jaw or plate members for laterally guiding the forwardly extending front end portion of the sole of the boot, while also acting as a stop arrangement for restricting the movement of the ski boot towards the tip of the ski. The side jaw members support a horizontal transverse spindle which in turn carries a double-armed retaining lever, the free end of the arm of the lever which faces away from the tip of the ski being of a bent configuration to form a hook engageable behind the retaining hook means on the forwardly extended end portion of the sole of the boot. The second arm of the lever can be secured to maintain the hooking engagement, whereby the front end portion of the sole of the boot is held to the base plate.

The double-armed lever is retained in the engaged position referred to above, by the second arm thereof being acted upon by a spring which urges it towards the position that it adopts in use of the ski binding. That means that for example the binding does not have a fixed or clearly defined open position, while in addition, while removing the boot from the binding, the retaining lever must be constantly held in an open or release position, for example by means of a ski stick. In addition, when fitting a boot into the ski binding, the retaining lever also has to be actuated to open the binding to receive the boot, if a layer of ice or snow has formed in the region of the front end of the sole of the boot, on the ski. That can easily occur by virtue of the binding being of an open construction, without affording any protection from such icing.

SUMMARY OF THE INVENTION

An object of the present invention is to provide a ski binding which is easy to operate and which has a fixed open position.

Another object of the present invention is to provide a ski binding which is of a closed construction thereby at least to contribute to preventing the penetration of snow or ice into the mechanism of the binding and thus substantially to reduce icing.

Yet another object of the present invention is to provide a ski binding wherein a retaining lever of the ski binding mechanism is secured in its engaged position by positive and form-locking interengagement, rather than by means of a spring loading.

Still another object of the present invention is to provide a cross-country binding wherein the mechanism is such that it will remain in an open position to receive a ski boot to be fixed to a ski, while still being of a basically simple construction.

These and other objects are achieved by means of a ski binding such as a cross-country ski binding for use with a ski boot having a front extension portion on the front end of the sole of the boot, the extension portion being of a stepped shape on its top to form a retaining hook configuration. A base plate is adapted to be fixed to the ski and has two side jaw members arranged for laterally guiding the front extension portion of the boot while also acting as a stop means for limiting the movement of the boot towards the tip of the ski. Mounted by the side jaw members is a transverse spindle carrying a double-armed retaining lever, a first arm of the lever being disposed towards the end of the base plate at which the front extension portion of a boot is inserted being of a bent configuration thereby forming a hook means adapted to engage behind the retaining hook means on the front extension portion of the sole of the boot. The second arm of the retaining lever can be secured in the position of the lever in which the hook means afforded by the first arm thereof is engaged with the front extension portion on the sole of the boot, the second arm being secured in that position by a locking element which is acted upon by a locking spring. The ski binding mechanism further includes a release button or like member which is mounted in coaxial relationship with the pivot mounting of the retaining lever and which is capable of limited pivotal movement with respect to the retaining lever. The locking element referred to above has an operative portion adapted to co-operate with the release button or like member whereby depressing the release button or like member displaces the locking element, against the force of its locking spring, in such a way as to release the second arm of the retaining lever. The retaining lever further has an abutment means which extends away from the release button or like member towards the base plate fixed to the ski, in the closed position of the binding mechanism, which abutment means can be engaged by the front extension portion on the boot.

As will be seen in greater detail hereinafter, in a specific embodiment of the present invention, actuation of the release button or like member firstly results in a release movement of the locking element, and then results in the retaining lever being entrained into an open position in which it remains even after the actuating force applied to the release button has been removed, thus releasing the button.

In a preferred embodiment, the locking element is in the form of a pivotally mounted lever, with the pivot mounting means for the locking lever being mounted in the side jaw members in parallel relationship to the pivot mounting of the retaining lever. The spring acting on the locking lever or element may be in the form of a torsion coil spring which extends around the spindle forming the pivot mounting means for the locking lever. The locking lever may also be of a double-armed configuration, with a second arm of the locking lever having an abutment surface which, in the position of use of the binding, bears against the base plate under the force of the spring loading the locking lever, thereby clearly defining the locking position of the locking lever. The other arm of the locking lever may carry at least one roller which is mounted in parallel relationship to the pivot mounting axis thereof, with the second arm of the retaining lever being arranged to bear against the periphery of the roller to facilitate relative movement of the components. The locking lever, at the end adjacent the above-mentioned roller, may have a projection portion which is capable of being engaged by the release button or like member in the closed position of the binding, whereby depression of the release button or like member acts on the projection portion to cause pivotal movement of the locking lever into the binding release position.

Further objects, features and advantages of a ski binding in accordance with the teachings of the present invention will become apparent from the following description of a preferred embodiment thereof.

DESCRIPTION OF THE PREFERRED EMBODIMENT

Figure 1:
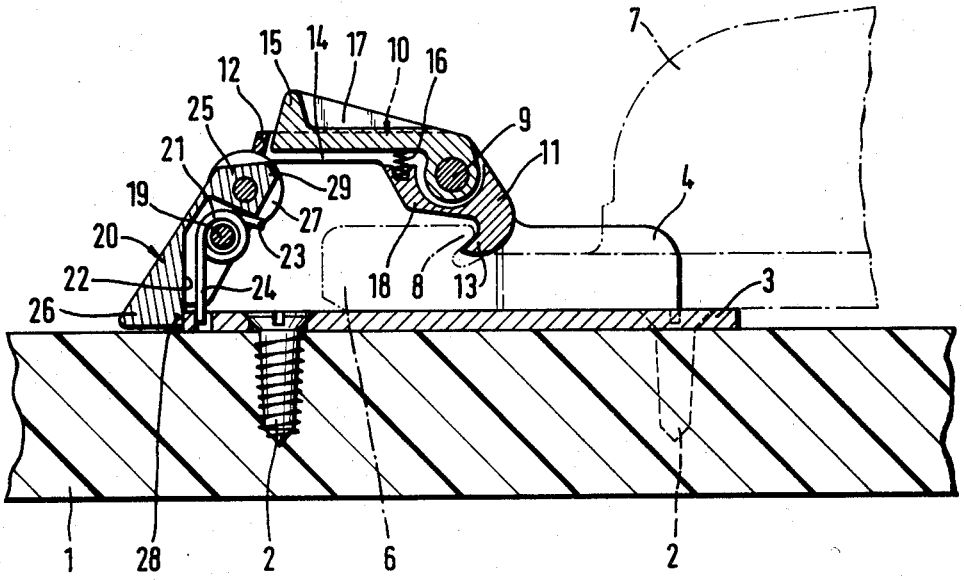
FIG. 1 is a view of an embodiment of a cross-country ski binding, in section taken along the longitudinal centre line thereof, in the condition of use of the binding mechanism.
Figure 2:
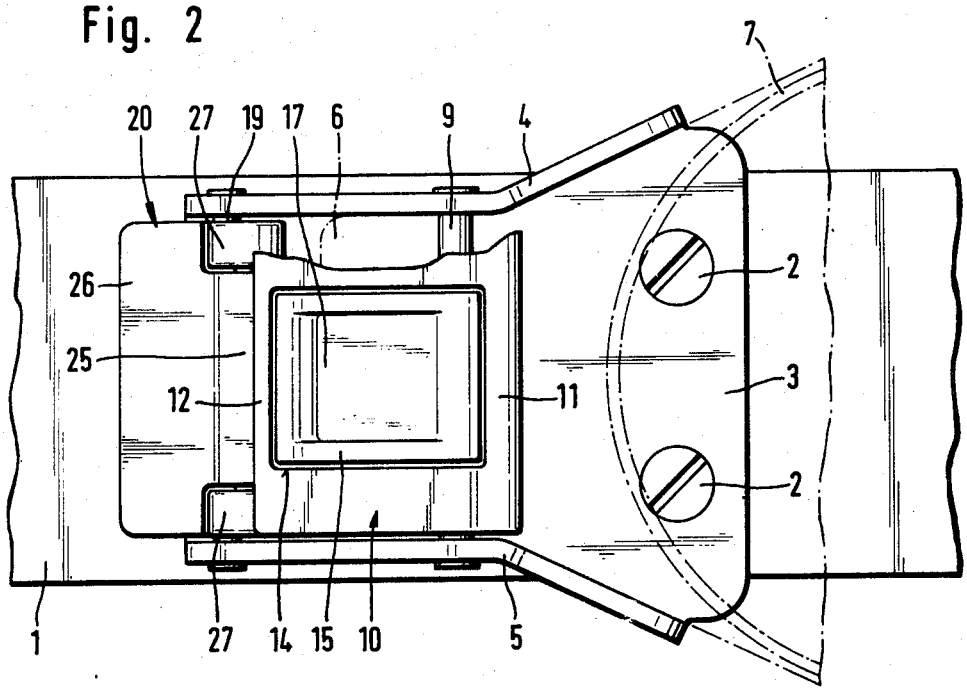
FIG. 2 shows a partly cut-away plan view of the binding shown in FIG. 1.

Referring firstly to FIG. 1, shown therein is a ski 1 such as a cross-country ski, to which a base plate 3 is secured by suitable screws as indicated at 2. The base plate 3 has two side portions 4 and 5 which extend upwardly therefrom in the normal position of use of the ski, thus forming side plates or jaw members. The side jaw members 4 and 5 serve on the one hand for laterally guiding a forwardly extended extension portion 6 on the front end of the sole of a cross-country ski boot which is shown in dash-dotted lines for example in FIG. 1 and which is indicated by reference numeral 7, while on the other hand the side jaw members also serve as a stop means for limiting the movement of the ski boot towards the tip of the ski. The front extension portion 6 on the sole of the boot is of a stepped configuration so as to form a retaining hook means as indicated at 8, the hook means 8 being of an undercut configuration so as to define a barb-like shape which points rearwardly towards the main part of the ski boot.

Mounted in the side jaw members 4 and 5 is a horizontal transverse pivot mounting member in the form of a spindle 9 which carries a pivotal retaining lever 10. The lever 10 comprises first and second arms as indicated at 11 and 12 for example in FIG. 1; it will be seen therefrom that, in the illustrated position of the mechanism, the arm 12 extends substantially horizontally and thus parallel to the ski 1, while the other arm 11 extends at an angle to the arm 12 and is directed downwardly towards the base plate 3 in the illustrated position. Furthermore, at its free end, the arm 11 is of a bent configuration thereby forming a hook 13 which is capable of engaging behind the hook means 8 formed on the top surface of the front extension portion of the sole of the boot.

The arm 12 of the retaining lever 10 has a central opening 14 which extends to a position over the spindle 9 and which serves to receive a release button or like member as indicated at 15. It will be seen from the drawings that the release member 15 is also mounted on the same spindle 9 on which the retaining lever 10 is mounted, so that the release member 15 is pivotal in coaxial relationship to the pivotal movement of the retaining lever 10. The release member 15 is capable of limited pivotal movement relative to the retaining lever 10, against the force of a holding spring indicated at 16 in FIGS. 1 and 3. The surface of the release member 15 which faces upwardly for example in the position of the binding mechanism shown in FIG. 1 has a trough or depression 17 into which the tip of a ski stick can be inserted for the purposes of opening the ski binding, as will be described in greater detail hereinafter.

Underneath the release member 15, the retaining lever 10 has an abutment 18 which can be acted upon by the front extension portion 6 of the ski boot, in a manner which will be described hereinafter.

The side jaw members 4 and 5 also carry a further pivot mounting in the illustrated form of a spindle 19 which is in parallel relationship to the horizontal transverse spindle 9. Pivotally mounted on the spindle 19 is a locking lever 20 which is loaded by a torsion coil spring 21 which is wound around the spindle 19. To accommodate the spring 21, the locking lever 20 has a recess as indicated at 22 for example in FIG. 1, which is in the rearwardly facing surface of the locking lever 20. The spring 21 has a limb 23 which bears against the locking lever 20 and a further limb 24 which bears against the base plate 3 at or adjacent the end thereof. The locking lever 20 is in the form of a straight lever with two arms 25 and 26 on respective sides of its pivot mounting on the spindle 19. The arm 25 serves as a locking arm, in a manner which will be desribed hereinafter, and carries two rollers 27 which are mounted in parallel relationship to the spindle 19 and which serve as locking members. The arm 25 may carry one roller, more than two rollers, or possibly no rollers at all. At its end which is the lower end in the position of use as shown for example in FIG. 1, the other arm 26 of the locking lever 20 has an abutment surface 28 with which it bears against the base plate 3 in the position of use of the binding as illustrated in FIG. 1. As can be seen from FIG. 1, in the illustrated embodiment, the surface 28 bears against the end face of the base plate 3.

Referring again to the locking arm 25, it will be seen that the arm 25 extends between the two rollers 27 to a position in the vicinity of the periphery thereof, and at that location forms a projection 29 which can be clearly seen from FIG. 1 and the purpose of which will be made clear hereinafter.

In FIG. 1, the cross-country ski binding is shown in its position of use in which it is securing a boot to the ski 1. As will be clearly apparent from FIG. 1, the hook 13 on the free end of the arm 11 of the retaining lever 10 engages behind the barb-like hook means 8 on the top surface of the front extension portion 6 of the sole of the cross-country ski boot 7, and thus secures the front end of the sole which also bears against the side jaw members 4 and 5, thereby to prevent the boot from being withdrawn from the binding. The retaining lever 10 is secured in its engagement position as illustrated in FIG. 1 by the arm 12 of the retaining lever 10 bearing against the periphery of the rollers 27 carried by the locking lever 20, in such a way that the bearing force is directed at least approximately radially with respect to the spindle 9. The locking lever 20 is held in the locking position illustrated by the spring 21.

For the purposes of releasing the boot from the binding, the release member 15 is actuated for example by means of a ski stick, pivoting the release member 15 against the force of its spring 16, being therefore a pivotal movement in a counter-clockwise direction in FIG. 1. When the release member 15 is operated in that way, the free end thereof, being the end which is towards the left in FIG. 1, bears against the projection 29 on the arm 25 of the locking lever 20. Upon further depression of the release member 15, the locking lever 20 will pivot in the clockwise direction in FIG. 1. As a result of that movement of the locking lever 20, the rollers 27 first come free from the arm 12 of the retaining lever 10. When finally the release member 15 has reached its lowermost limit position relative to the retaining lever 10, in relation to which it is capable of limited pivotal movement, the release member 15 will entrain the retaining lever 10 as further pressure is applied to the release member 15 to urge it further in a counter-clockwise direction. When that happens, the free end of the arm 12 of the retaining lever 10 against comes into contact with the peripheral surfaces of the two rollers 27, but in this case in such a fashion that the pressure applied to the rollers is applied along a line which passes to the right of the spindle 19 in the view shown for example in FIG. 1, so that the locking lever 20 is then further pivoted against the force of the spring 21 into the open position shown in FIG. 3. The boot can thus be withdrawn from the ski binding, as the hook 13 on the retaining lever 10 is now clear of the hook means 8 on the front extension portion of the sole of the boot.

Figure 3:
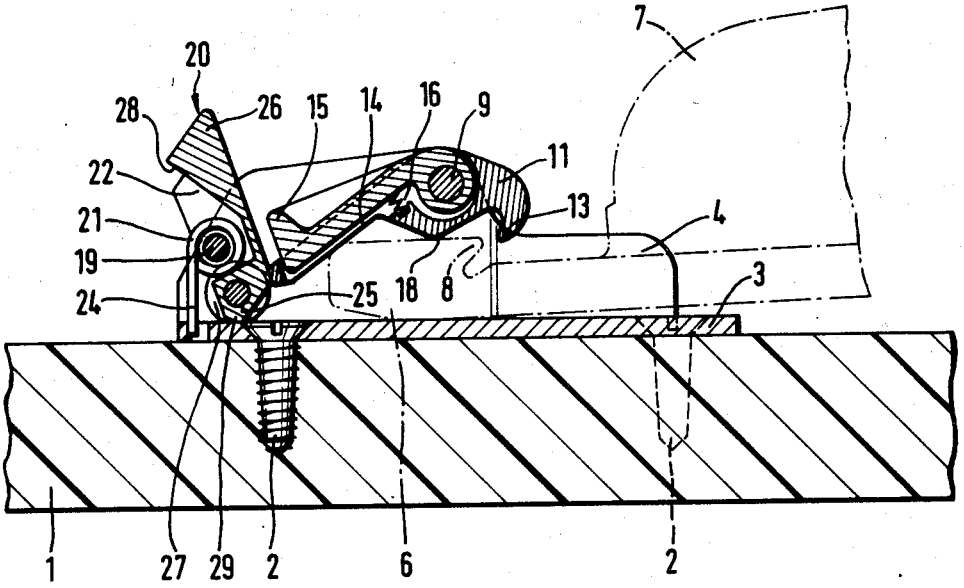
FIG. 3 is a view corresponding to that shown in FIG. 2, but illustrating the binding in the open position.

When the pressure applied to the release member 15 is removed, the binding remains in the open position shown in FIG. 3, as the force of the spring 21 loading the locking lever 20 is directed normal to the arm 12 of the retaining lever 10, which therefore secures the binding in the fixed and clearly defined open position thereof as illustrated.

Referring to FIG. 3, in order for the cross-country ski boot which is again indicated at 7 and shown by dash-dotted lines to be fixed in the binding, with automatic closure of the binding, it is only necessary for the ski boot to be pivoted into its appropriate position in relation to the ski binding and the ski. That movement results in a pivotal movement of the retaining lever 10 in a clockwise direction about its mounting spindle 9, as the front extension portion 6 of the sole of the boot bears by way of its top surface against the abutment 18 provided on the underside of the retaining lever 10, and thus pivots it in the clockwise direction in FIG. 3 until it no longer blocks the locking lever 20 in the FIG. 3 position; on the contrary, it is further pivoted thereby, under the force of the spring 21, into the position of use as shown in FIG. 1. The front extension portion 6 of the sole of the boot 7 is thus secured in the ski binding by the hook 13 on the retaining lever engaging behind the hook means formed in the top surface of the front extension portion 6 of the boot 7.

It will be seen from the foregoing description of the preferred embodiment therefore that the ski binding is easy to operate and has a fixed and clearly defined open position which makes it very easy to fix a ski boot in the binding. The binding is of a generally closed construction, for example with the pivot mounting of the locking lever 20 being behind the body of the locking lever and thus substantially protected from snow and ice, and likewise in regard to the spring 21 thereof, thereby substantially contributing to preventing snow and ice from penetrating into the mechanism of the binding with all the disadvantages that that entails. It will be further appreciated that the retaining lever 10 is secured in its engaged position as shown in FIG. 1 by positive interengagement with the locking lever 20, rather than being held in that position directly by means of a spring loading.

It will be appreciated that the above-described embodiment of the ski binding according to this invention has been described only by way of example thereof, and various modifications and alterations may be made therein without thereby departing from the spirit and scope of the present invention.

What is claimed is:

1. A cross-country ski binding for a ski boot having a front extension portion on the sole of the boot, said extension portion being of a stepped configuration to form a retaining means on its top side, comprising a base plate which is to be fixed to the ski and which carries a pair of side jaw members for laterally guiding the front extension portion and to act as a stop means for restricting movement of the ski boot towards the tip of the ski, a horizontal transverse pivot mounting means carried by said side jaw members, a double-armed retaining lever pivotally mounted on said pivot mounting means and having a first arm which faces towards the boot insertion end of the binding and provides a hook means operable to engage the retaining means on the front extension portion of the boot sole, and a second arm, a locking element co-operable with said second arm of said retaining lever to secure same in the position of said retaining lever in which said hook means of said first arm and said retaining means on the front extension portion of the boot sole are interengaged, a spring urging the locking element towards the position of securing said retaining lever in said interengaged condition, and a release member disposed pivotally coaxially with respect to the retaining lever and capable of limited pivotal movement with respect thereto, the locking element having an operative portion co-operable with the release member whereby actuation of the release member causes release movement of the locking element to release said retaining lever, and the retaining lever having an abutment means which extends away from the release member towards said base plate and which is engageable by the front extension portion of said boot sole upon insertion of the boot into the binding.

2. A binding as set forth in claim 1 wherein said locking element is in the form of a pivotal lever and further including a pivotal mounting means for said locking lever, mounted in said side jaw members in parallel relationship to the pivot mounting means for the retaining lever.

3. A binding as set forth in claim 2 wherein said locking element spring is formed as a coiled bending spring and is mounted on the pivot mounting means mounting the locking lever.

4. A binding as set forth in claim 2 wherein said locking lever has first and second arms, the second arm having a stop surface which, in the closed position of use of the binding, bears against the base plate under the force of said spring.

5. A binding as set forth in claim 4 wherein said stop surface is adapted to bear against an end face of said base plate.

6. A binding as set forth in claim 4 wherein the first arm of the locking lever carries at least one roller which is mounted in parallel relationship to the pivot axis thereof, the second arm of said retaining lever bearing against the periphery of said roller.

7. A binding as set forth in claim 4 wherein the first arm of the locking lever has a portion which, in the closed position of use of the binding, extends into the range of pivotal movement of the release member so as to be engageable thereby to displace the locking lever into the position of releasing the retaining lever.

8. A cross-country ski binding including: a base unit securable to a ski and comprising a base plate which is arranged to bear against the top surface of the ski and first and second side jaw members at respective sides of the base plate defining a channel for accommodating a front extension portion on the sole of a ski boot; transverse pivot mounting means on said first and second side jaw members; a double-armed retaining lever pivotally mounted on said pivot mounting means, the retaining lever having a first arm which is directed rearwardly of the binding and provides a configuration such as to form a hook means operable to engage with a retaining means on the top surface of the front extension portion of the sole of the boot, and the second arm of the retaining lever extending forwardly of the binding, the retaining lever being pivotable between a binding-closed position in which said hook means is engaged with said retaining means and a binding-open position in which said hook means is disengaged from said retaining means; a release member mounted pivotally coaxially with respect to the retaining lever and capable of limited pivotal movement with respect to the retaining lever; a locking element pivotally mounted to the base unit and pivotable between a position of locking said retaining lever in its binding-closed position and a position of releasing said retaining lever; a spring means urging the locking element towards its locking position; the locking element having an operative portion co-operable with said release member whereby actuation of said release member causes pivotal movement of said locking element against said spring means from its locking position towards it release position; the retaining level having a portion engageable by said front extension portion of the sole of the boot upon insertion thereof into said channel when said retaining lever is in the binding-open position thereby to urge said retaining lever towards the binding-closed position.

9. A binding as set forth in claim 8 wherein said locking element comprises a lever having first and second ends and mounted pivotally at a location intermediate said first and second ends, said second end providing said operative portion co-operable with said release member and said second end further carrying at least one roller mounted in parallel relationship to the pivot axic thereof, a free end of said second arm of said retaining lever bearing against the peripheral surface of said roller in the closed condition of the binding.

10. A binding as set forth in claim 9 wherein said operative portion of said locking element is a projection portion disposed adjacent said at least one roller.

* * * * *